US006617779B1

(12) United States Patent
Schwartz

(10) Patent No.: US 6,617,779 B1
(45) Date of Patent: Sep. 9, 2003

(54) MULTI-BEND CATHODE RAY TUBE

(76) Inventor: Samuel A. Schwartz, P.O. Box 2066, Saratoga, CA (US) 95070

( * ) Notice: Subject to any disclaimer, the term of this patent is extended or adjusted under 35 U.S.C. 154(b) by 0 days.

(21) Appl. No.: 09/970,565

(22) Filed: Oct. 4, 2001

(51) Int. Cl.[7] ..... H01J 3/20; H01J 3/24; H01J 3/32

(52) U.S. Cl. ..... 313/431; 313/433; 313/426

(58) Field of Search ..... 313/422, 423, 313/426, 427, 430, 431, 433, 440, 442; 335/210; 315/364, 368.28, 368.27; 348/828, 829, 830

(56) References Cited

U.S. PATENT DOCUMENTS

| | | | | |
|---|---|---|---|---|
| 2,156,915 A | | 5/1939 | Knoll | |
| 2,158,314 A | | 5/1939 | von Korshenewsky | |
| 2,163,787 A | | 6/1939 | Henneberg et al. | |
| 2,164,555 A | | 7/1939 | Truell | |
| 2,211,613 A | | 8/1940 | Bowie | |
| 2,222,955 A | | 11/1940 | Orthuber et al. | |
| 2,332,876 A | | 10/1943 | Uhlmann | |
| 2,436,393 A | | 2/1948 | Maggio | |
| 2,464,562 A | | 3/1949 | Diemer | |
| 2,728,025 A | | 12/1955 | Weimer | |
| 2,915,673 A | | 12/1959 | Atti | |
| 2,945,974 A | | 7/1960 | Aiken | |
| 3,080,500 A | | 3/1963 | Preston | |
| 3,412,282 A | | 11/1968 | De Lord et al. | |
| 3,979,631 A | | 9/1976 | van der Ven | |
| 4,389,572 A | * | 6/1983 | Hutcheon | 250/396 R |
| 4,445,041 A | | 4/1984 | Kelly et al. | |
| 4,713,581 A | | 12/1987 | Haimson | |
| 4,739,218 A | | 4/1988 | Schwartz | |
| 4,808,890 A | * | 2/1989 | Yamazaki | 315/366 |
| 4,992,656 A | | 2/1991 | Clauser | |

(List continued on next page.)

FOREIGN PATENT DOCUMENTS

| | | |
|---|---|---|
| FR | 1052647 | 1/1954 |
| FR | 1064959 | 5/1954 |
| GB | 1202563 | 8/1970 |

OTHER PUBLICATIONS

Enge, H. A., "Achromatic Magnetic Mirror for Ion Beams," The Review of Scientific Instruments, vol. 34, No. 4, pp. 385–389, 1963.

Livingood, J. J., "Achromatic Single Magnets," Chapter 14, The Optics of Dipole Magnets, 1969, pp. 191–1999, Academic Press, New York and London.

Moss, H., "Narrow Angle Electron Guns and Cathode Ray Tubes," Supplement 3 to Advances in Electronics and Electron Physics, 1968, pp. 110–117, Academic Press, New York and London.

Schwartz, S. A., "Short Cathode Ray Tube," Proceedings of the SID, vol. 28/1, 1987, pp. 3–8.

Weimer, P. K. and Rynn, N., "A 45–Degree Reflection–Type Color Kinescope," Proceedings of the I.R.E., Oct. 1951, pp. 1201–1211.

*Primary Examiner*—Ashok Patel
*Assistant Examiner*—Karabi Guharay
(74) *Attorney, Agent, or Firm*—Warren S. Wolfeld; Haynes Beffel & Wolfeld LLP

(57) ABSTRACT

Roughly described, a CRT contains a magnetic loop bender which causes the beam to undergo a 270° (for example) bend and intersect itself before exiting the bender orthogonally with the screen. Downstream of the bender, the beam is deflected by conventional biaxial scanning means before impingement on the screen. A magnetic field stop plate can be added in a plane that passes through the beam intersection point and that lies parallel to the pole termination plane of the bender magnetic structure. An astigmatic beam shaping mechanism can also be included, as can post-deflection acceleration of the beam to provide further shortening of the tube depth as well as a focusing action that reduces the effect of beam enlargement due to mutual electron repulsion within the beam. All of the beam bending and deflection can be done by externally attached components.

77 Claims, 4 Drawing Sheets

U.S. PATENT DOCUMENTS 5,434,420 A 7/1995 McKeown et al.
5,479,238 A 12/1995 Whitney
5,508,515 A * 4/1996 Enge ..... 250/281
5,618,760 A 4/1997 Soh et al.
5,623,183 A 4/1997 Allen et al.
5,753,922 A 5/1998 Nakasuji
5,841,145 A 11/1998 Satoh et al.
5,872,432 A 2/1999 Beeteson
5,981,947 A 11/1999 Nakasuji et al.
6,150,760 A 11/2000 Tsuchiya et al.
6,178,226 B1 1/2001 Hell et al.
6,218,773 B1 4/2001 Misono et al.
6,225,766 B1 5/2001 Ono et al.
6,232,709 B1 5/2001 Retsky
6,232,711 B1 5/2001 Sugiyama et al.
6,259,206 B1 7/2001 Tsuchiya et al.

* cited by examiner

MULTI-BEND CATHODE RAY TUBE

BACKGROUND

1. Field of the Invention

The invention relates to scanning cathode ray tubes, and more particularly to cathode ray tubes incorporating a folded electron beam path en route to the display screen.

2. Description of Related Art

A typical cathode ray tube comprises an evacuated glass envelope having a neck portion oriented orthogonally to a fluorescent display screen. The neck region contains one or more electron guns, and opens up into a funnel or cone section which terminates in the display screen. A biaxially controllable magnetic deflection yoke is disposed coaxially outside the tube at the junction between the neck section and the cone section.

It is known that electron beam quality can be improved by the use of certain electron guns that either are longer than the electron guns in conventional use today, or have a larger diameter than conventional electron guns. Longer guns are not used in part because they would add depth to the television display cabinet, which is undesirable from a commercial point of view. Larger diameter guns are not used presumably because they would require a larger diameter neck, which in turn would require (in most cases) a larger diameter yoke. A larger diameter yoke would in turn require larger drive currents or greater interaction lengths in order to achieve the same horizontal and vertical deflection angles.

One way to accommodate a longer or larger diameter electron gun might be to create a cathode ray tube having a folded electron beam path en route to the display screen. Some examples of such tubes are illustrated in U.S. Pat. Nos. 2,164,555, 2,464,562, 2,728,025, 2,945,974 and 3,412,282, all incorporated by reference herein. In each of these tubes, the electron beam is subjected to both horizontal and vertical deflection, with a subsequent folding of the beam path en route to the screen. However, it is believed that the systems of these patents are suitable only for small size tubes, due to the limitations of the two-dimensional beam folding mechanisms that are used. Such limitations include both beam absorption and image distortion.

In Schwartz U.S. Pat. No. 4,739,218, a cathode ray tube is disclosed in which the horizontal and vertical deflection mechanisms are separated, and the electron beam path is bent by 90° in the region between the separated deflection mechanisms. The Schwartz system avoids many of the problems of the prior art, but still has some difficulties of its own. For example, in an embodiment in which the right angle bender operates electrostatically, a number of additional components are required inside the glass. Such components are not always compatible with existing CRT production lines. In addition, significant deflection defocusing can sometimes occur due to the differential energy change that can occur at the opposite edges of the electron beam.

The Schwartz patent also indicates that the right angle bender mechanism may be magnetic instead of electrostatic. A magnetic bender and deflection structure would simplify the internal structure of the tube because all of the magnetic components can be placed outside the tube. However, as indicated in the patent, the stability of the bending angle produced by the right angle magnetic bender depends on the stability of the high voltage accelerating potential applied to the tube. That is, whenever the high voltage potential increases or decreases slightly, the velocity of the electron beam entering the bender will also increase or decrease. This will result in an uncontrolled reduction or increase in the bending angle. Instability in the high voltage supply therefore appears as undesirable instability in the vertical position of the image produced on the display.

Another difficulty with a magnetic right angle bender is that the magnetic field in some embodiments can extend or "leak" back into the gun area, causing the beam to enter the bender off-center. It may be possible to design and install a "pusher" magnet along the electron beam path between the gun and the bender, to counteract the effect of the bender leakage magnetic field in that region by pushing the partially deflected electron beam back into the center of the desired beam path, but this arrangement can greatly compound the sensitivity of the bending angle to changes in the high voltage supply.

In addition to the above difficulties, a magnetic right angle bender also does not completely avoid deflection defocusing because in some embodiments, diametrically opposite edges of the electron beam will be affected differently by the magnetic bender field. In particular, the outer edge of the beam as it makes the bend has a greater interaction length with the magnetic field, and therefore is bent by a slightly greater angle than is the inner edge of the beam. Thus an edge crossover occurs either as the beam passes through the bender or at some point downstream of the bender. One might suspect that a system can be designed to position the edge crossover point all the way out at the display screen and thereby improve focus at the display screen, but it turns out that the edge crossover point is very difficult to control and in fact renders focus at the display screen problematical.

Accordingly, there is a need for a folded electron beam path cathode ray tube which overcomes the problems of the electrostatic and magnetic right angle benders of the prior art.

SUMMARY OF THE INVENTION

According to the invention, roughly described, a cathode ray tube contains an electron beam source whose central axis is essentially parallel with the plane of the tube's fluorescent display screen. The path of the beam undergoes large angular bending through a magnetic loop bender, causing the beam to intersect itself before exiting the bender orthogonally with the screen. Because of the symmetries inherent in a loop bender, the bending angle is not sensitive to variations in the beam velocity or the high voltage potential of the tube. Downstream of the bender, the beam is deflected by conventional biaxial means before impingement on the screen. A magnetic field stop can be added at the entrance port of the bender in order to prevent the bender's leakage field from affecting the beam path before it enters the bender's main field. A magnetic field stop can also be added at the exiting port of the bender to isolate the bender magnetic field from the yoke magnetic field. Preferably both magnetic field stopping functions are performed by a single magnetic flux conductor having a surface nearest the bender magnet structure, which surface lies in a plane that passes through the beam intersection point (i.e. that point where the beam entering the bender intersects the beam leaving the bender) and that lies parallel to the pole termination plane of the bender magnetic structure.

The overall result of this configuration is a large reduction in the physical depth of the tube, as well as the provision of sufficient space for a large electron gun for the purpose of minimizing beam aberration. A longer electron gun can be used because it does not increase the overall tube depth, and a larger diameter electron gun can be used because the diameter of the neck section of the tube imposes no constraints on the diameter of the section around which the yoke is disposed.

An astigmatic beam shaping mechanism can also be included prior to the conventional deflection yoke. In addition, post-deflection acceleration of the beam can provide further shortening of the tube depth as well as a focusing action that reduces the effect of beam enlargement due to mutual electron repulsion within the beam. All of the beam bending and deflection can be done by externally attached components so that there are no internal electrostatic elements other than those in the electron gun and the conventional conductive inner coatings. For color applications, the well-known beam index method may be used. The overall display size of a tube made according to the invention is limited only by the size of the glass enclosure, and production may be carried out on conventional established CRT production lines.

BRIEF DESCRIPTION OF THE DRAWINGS

The invention will be described with respect to particular embodiments thereof, and reference will be made to the drawings, in which.

DETAILED DESCRIPTION

Figure 1:
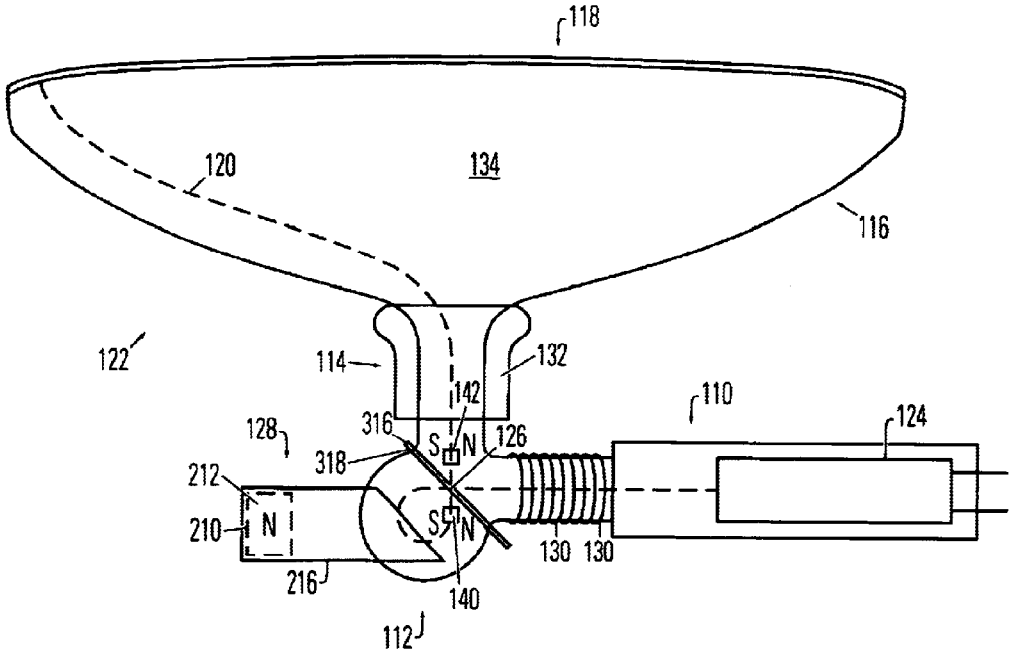
FIG. 1 is a top view schematic diagram of a cathode ray tube incorporating features of the invention.

FIG. 1 is a top view schematic diagram of a cathode ray tube incorporating features of the invention. It comprises, in sequence along the path of an electron beam, a neck section 110, a magnetic loop bender 112, a biaxial deflection section 114, a cone or funnel section 116, and a display screen 118. As used herein, sections along the path of the electron beam are defined as being "upstream" or "downstream" of each other relative to the path of the electron beam. In some embodiments, the display screen 118 is flat, and lies in what is referred to herein as the "plane of the display screen." In other embodiments the display screen is curved somewhat, in which case the plane of the display screen is considered to be a plane tangent to the center of the display screen. The inner or back surface of the display screen is coated in a conventional manner with a fluorescent material, and then with an electrically conductive and optically reflective aluminum backing.

The path of electron beam is illustrated by dashed line 120, and is entirely enclosed within an evacuated glass envelope 122. The neck section 110 also encloses an electron gun 124, which can be longer than the guns typically used in commercial television sets, or it can have a larger diameter, or both. In the embodiment of FIG. 1, the electron beam enters the bender section 112 from the side, in a plane that also contains the long axis of the display screen. In other embodiments, the electron beam can enter from other angles, such as from the top or bottom, or diagonally.

Magnetic Loop Bender

The electron beam 120 enters the loop bender 112 from the right (as viewed from the top) and is bent through an angle of 270° before exiting orthogonally to the plane of the display screen. As used herein, a "loop bender" is a structure which deflects or bends an electron beam through an angle between 180° and 360°, exclusive. The bender thus creates a beam intersection point, in which the output beam intersects the input beam before reaching the display screen. In the embodiment of FIG. 1, the beam intersection point is labeled 126. The bending angle chosen for a given embodiment depends on the angle that the input electron beam makes with the plane of the display screen, and depends further on the design and placement of the X-Y deflection mechanism. In the present embodiment, the input electron beam travels substantially parallel to the plane of the display screen, and the X-Y deflection mechanism is disposed between the bender and the display screen. In addition, the X-Y deflection mechanism comprises an electromagnetic yoke, and the X deflection portion of the yoke is designed to deflect the beam by equal positive and negative maximum deflection angles in the plane of the bending loop. Thus the present embodiment employs a loop bender which bends the input beam by an angle of approximately 270°. The exact angle is not critical, because small errors can be compensated in the yoke electronics or in the position of the bender magnet, either fixedly or by calibration. In general, the bending angle should be between 225° and 315°, inclusive. Also, an embodiment is not precluded in which the loop includes some out-of-plane deviation, such that the output beam passes next to the input beam rather than actually intersecting it. In such embodiments of phrases "plane of the bending loop" and "pending plane" refer to an average plane of the loop. Such embodiments are included in the term "loop bender," because when projected onto this average plane, the path still includes a beam intersection.

Figure 2:
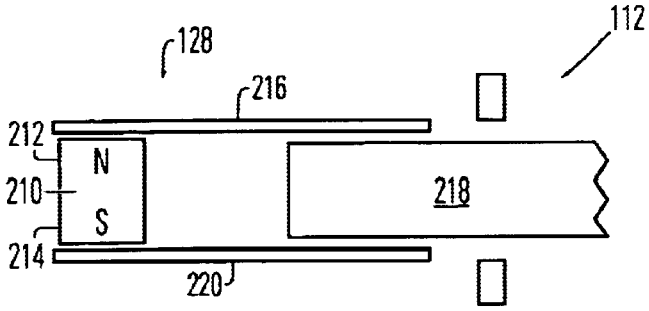
FIG. 2 is a rear view of the bender magnet structure and a portion of the bender section of the tube of FIG. 1.

The bender 112 uses a bender magnet structure 128 in order to cause the electron beam 120 to bend through the loop. As used herein, the term "bender magnet structure" is intended to accommodate structures that are not purely a magnet. They can include one or more pole pieces, for example, and can also include permanent magnets and/or electromagnets. The bender magnet structure 128 is better seen in FIG. 2, which shows a rear view of the bender magnet structure 128 and a portion of the bender section 112 of the tube of FIG. 1. It can be seen that the bender magnet structure 128 includes a permanent magnet 210 having a North pole 212 and a South pole 214. The North pole 212 is on the upper side of the magnet 210 in the view of FIG. 2, and the South pole 214 is on the lower side. The North pole 212 is also visible as the end of the magnet 210 nearest the viewer in FIG. 1.

A North side pole piece 216, also visible in FIG. 1, carries magnetic flux from the North pole 212 of the magnet 210 to the upper side (in the view of FIG. 2) of the glass bender portion 218 of the tube 122, and a South side pole piece 220 carries magnetic flux to the South pole 214 of the magnet 210 from the lower side (in the view of FIG. 2) of the glass bender portion 218. Both pole pieces extend only partially over the glass bender portion 218 as illustrated more clearly in FIG. 1. In particular, both the North and South pole pieces terminate in a "pole termination plane" which is perpendicular to the plane of the page in FIG. 1 and which is also perpendicular to the plane of the bending loop. It defines the edges of both pole pieces 216 and 220 that overlap the bend section 112 of the tube. In addition, a normal to the pole termination plane bears an equal angle to the electron beam both entering and exiting the bender 112. In the embodiment of FIG. 1 in particular, a normal to the pole termination plane bears a 45° angle to each of the input electron beam and the output electron beam.

Figure 3:
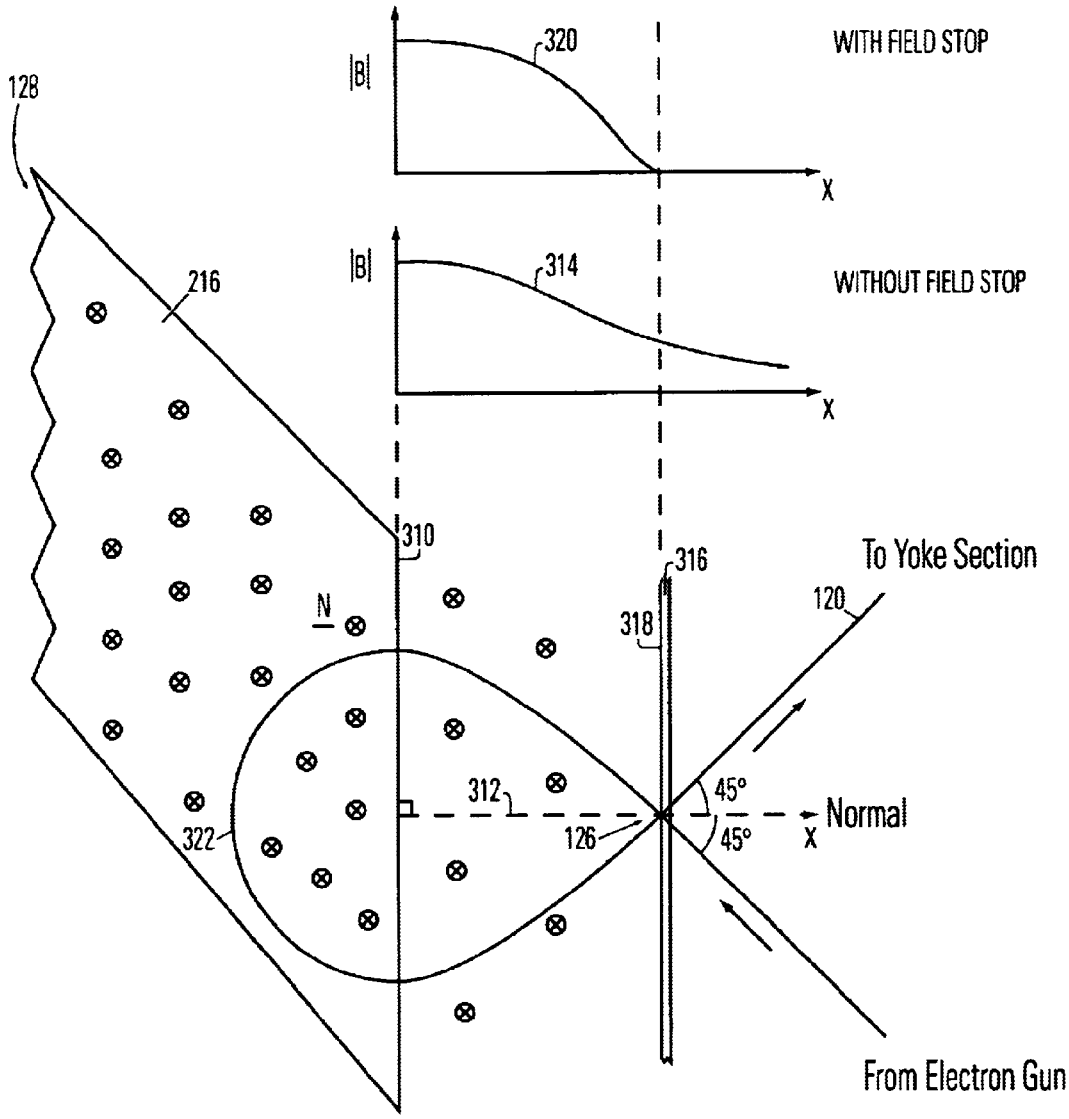
FIG. 3 is a top view of the portion of the electron beam path in the bender of FIG. 1.

FIG. 3 is a top view of the portion of the electron beam path 120 in the bender 112. The figure has been rotated clockwise by 45° relative to the view shown in FIG. 1, to better illustrate the effect of the bender magnetic field. In the view of FIG. 3, the North side pole piece 216 is visible and terminates at the pole termination plane 310 which is vertical and perpendicular to the plane of the page of FIG. 3. A normal 312 to the pole termination plane 310 is illustrated in the figure, and it can be seen that it makes a 45° angle with both the incoming electron beam and the outgoing electron beam. The direction of the magnetic field is from the North pole to the South pole, meaning that it is directed into the page away from the viewer as indicated by the circle-cross symbols in the figure. The bender magnetic field is strong between the pole pieces 216 and 220, but weakens as one moves off to the right in the direction of the normal 312. The loop made by the electron beam trajectory is therefore more egg-shaped than circular, the bending radius being tighter on the left side of the loop than on the right side of the loop. The loop is, however, symmetrical about the normal vector 312 in the plane of the page.

The curve 314 in FIG. 3 illustrates the magnitude of the magnetic flux as one moves outward along the normal 312 from the pole termination plane 310. As can be seen, the magnetic field magnitude starts high and gradually falls off as one moves outward along the normal, but never quite reaches zero. This means that absent additional protection, the bender magnetic field will continue to have an influence back into the electron gun region of the tube as well as out into the magnetic deflection yoke region. In addition, the magnetic field from the deflection yoke region can have an influence back into the bender. All of these are undesirable from a design point of view.

Accordingly, the embodiment of FIG. 1 also includes a magnetic field stop 316, which is a magnetic flux conductor having a front surface 318 which is nearest the bender magnet structure 128, and which lies in a plane which is parallel to the pole termination plane 310. The magnetic field stop 316 may be a U-shaped block of material rather than a plate as shown in FIG. 3, as long as the front surface 318 has the desired position and orientation. Curve 320 in FIG. 3 illustrates the magnitude of the bender magnetic field when the magnetic field stop 316 is in place as shown in FIG. 3. As can be seen, the magnetic field magnitude starts at the same level as it does in curve 314, and gradually falls off as one moves outward along the normal, but unlike curve 314, curve 320 falls off to essentially zero at the front surface 318 of the magnetic field stop 316. The bender magnetic field therefore will have no influence or virtually no influence beyond the front surface 318 of the magnetic field stop 316.

As long as the front surface 318 of the magnetic field stop 316 is oriented parallel to the pole termination plane 310, and the bending magnetic field is symmetrical about the normal 312 in the bending plane, the path of the beam within the non-zero bending magnetic field also will be symmetrical about the normal 312 in the bending plane. Thus the angle of the beam as it exits the bending magnetic field will always be equal and opposite to the angle at which it enters, both measured relative to the normal 312. The absolute magnitude of the bending magnetic field and the shape of its fall off curve 320 have virtually no affect on the total bending angle. Nor does the beam velocity as it enters the bending magnetic field. These factors affect the shape and size of the loop itself, but not the symmetry of the angles at which the beam enters and exits. Of course the bending magnetic field should not be made so weak that the loop enlarges to strike or approach the walls of the glass envelope, nor so strong that the magnetic field stop 316 does not sufficiently reduce its magnitude beyond the front surface 318.

Also because of these symmetries, nearly any desired total bending angle from 180° to 360° exclusive, theoretically can be achieved by appropriately orienting the pole termination plane 310 and the front surface 318 of the magnetic field stop 316 relative to the incoming beam. heretofore been recognized and used in a cathode ray tube in which the bender is followed by a biaxial scanning deflection mechanism.

Despite the benefits of symmetry, it will be appreciated that some embodiments may employ a non-symmetrical magnetic bending field. Such a field can be formed, for example, by orienting the front surface 318 of the magnetic field stop 316 in non-parallel relationship to the pole termination plane 310. In other variations, the field termination surface 310 and/or the front surface 318 of the magnetic field stop 316 can be made nonplanar. These variations will affect the position of the beam intersection point and the total bending angle, and may even result in a non-planar loop. These are design choices that may be implemented in various embodiments, and their consequences may either be desired for the particular design, or compensated for in other components of the system.

Figure 4:
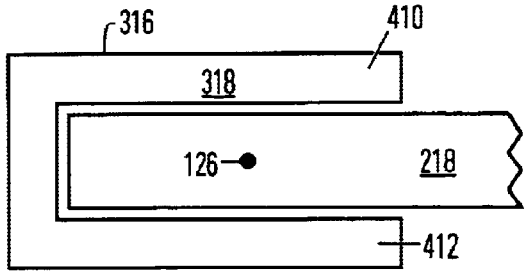
FIG. 4 is a diagonal top view of the magnetic field stop in FIG. 1, taken from a direction normal to and facing the front surface of the magnetic field stop.

FIG. 4 is a diagonal top view of the magnetic field stop 316, taken from a direction normal to and facing the front surface 318 of the magnetic field stop 316. Also shown is a portion of the glass bender section 112 of the tube 122. As can be seen, the magnetic field stop 316 is essentially a squared-off U-shape cut out of a plate of magnetic flux conductive material, such as iron or ferrite. The U-shaped plate surrounds the glass enclosure of the bender 112 on three sides (at least) including two arms 410 and 412 which extend considerably beyond the beam intersection point 126. The magnetic field stop 316 is entirely outside the glass envelope of the tube 122. Other shapes for the magnetic field stop 316 are possible as well and will be apparent to a person of ordinary skill.

Referring again to FIG. 1, it can be seen that the neck 110 of the tube 122 between the electron gun 124 and the magnetic loop bender section 112 is wrapped with a magnetic shield material such as iron wire 130. As another example the magnetic shield material may comprise a For example, to produce a total bending angle of 270°, these two planes should be oriented at a 45° angle to the path of the incoming beam, as shown in FIG. 3. Stated another way, the normal 312 should be oriented at a 45° angle relative to the incoming beam. To produce a total bending angle of 315°, the planes should be oriented at a 22.5° angle relative to the incoming beam (or the normal 312 oriented at a 67.5° angle relative to the incoming beam). To produce a total bending angle of 225°, the planes should be oriented at a 67.5° angle relative to the incoming beam (or the normal 312 oriented at a 22.5° angle relative to the incoming beam).

The symmetry of the bending loop in the bending magnetic field is also responsible for minimizing or eliminating the deflection defocusing that can occur in magnetic right angle benders. In particular, the path of all parts of the beam cross-section as it passes through the bender have approximately the same interaction length, and therefore no part of the beam is deflected by any greater amount than any other part of the beam. This can be seen by considering that the incoming electron beam 120 in FIG. 3 has some cross-sectional diameter in the plane of the page. Then the trajectory followed by one edge of the beam in the plane of the page will be symmetrical about a first normal and the trajectory followed by the other edge of the beam in the plane of the page will be symmetrical about a second normal. The first and second normals are slightly separate from each other in the plane of the page, but the rule that the angle of incidence into the bending field is equal and opposite to the angle of exit, applies equally to the trajectories of both edges. Thus if the inner and outer edges are parallel to each other on entering the bending field, they will also be parallel to each other upon exiting. A beam edge crossover takes place at the far end 322 of the loop in line with the normal 312, and the exiting beam cross-section is mirrored relative to the incoming beam cross-section, but no additional beam defocusing occurs in the magnetic loop bender 112. Loop benders and their symmetries are known in other fields of technology, but they have not flat shield material. This material provides additional magnetic field isolation between the electron gun 124 and the bender section 112 in order to ensure that the bender magnetic field does not extend back into the gun region 124 to any significant extent. Such additional magnetic field isolation may or may not be required in various embodiments.

Biaxial Deflection Section

After the electron beam 120 exits the bender region 112, it passes through a biaxial electromagnetic deflection region 114 which may comprise, for example, a deflection yoke 132. Because the electron gun diameter 124 does not restrict the cross-sectional dimensions of the glass envelope 122 within the deflection region 114, the cross-sectional dimensions within the deflection region 114 can be made relatively small (but within the structural integrity limits of the tube). The cross-sectional dimensions of the yoke 132 therefore can also be made smaller than in a conventional tube, allowing the electromagnetic coils to be disposed more closely to the electron beam 120. A particular embodiment of the invention can take advantage of this proximity either by reducing the current flow through the coils, or by shortening the length of the deflection region, or both. Once these choices are made, the design of the yoke and of the control electronics is conventional. In the particular embodiment of FIG. 1, a cross-section of the glass envelope 122 within the deflection section 114 is rectangular rather than circular. This, too, can be accommodated using conventional yoke design techniques.

The yoke 132 performs horizontal and vertical deflection in a conventional manner. In the embodiment described herein, the horizontal portion of the yoke and control electronics are designed to deflect the beam by equal positive and negative maximum deflection angles in the plane of the bending loop (i.e., in the horizontal dimension, for embodiments in which the electron beam enters the bender 112 from the side). Thus the bender 112 is designed to produce an output beam generally orthogonal to the display screen. In another embodiment, the bender can be designed to bend the beam through a smaller or larger angle, and/or the incoming beam can be oriented non-parallel to the display screen, such that in the absence of subsequent deflection the output beam will be directed toward the left or right side of the screen, respectively (top or bottom of the screen, for embodiments in which the input beam enters the bender 112 from below). In such an embodiment the yoke and the control electronics can be designed for asymmetric maximum deflection angles in the plane of the bending loop.

Funnel Section

After the electron beam 120 leaves the deflection section 114, it enters the cone or funnel section 116 of the tube. In one embodiment, the funnel section 116 is made free of electric fields by ensuring that the aluminum backing on the display screen 118, as well as all of the inside surfaces of the glass envelope all the way back to into the neck section 110, are at the same electrical potential. As in a conventional cathode ray tube, this can be accomplished by coating the inner surface of the tube, back into the neck section, with an electrically conductive dag. The dag is connected electrically to the aluminum backing on the display screen 118, and also to the appropriate high voltage node on the electron gun. High voltage is applied to the dag by a high voltage button passing through a side surface of the funnel section of the glass envelope.

In such a field-free embodiment, the electron beam 120 follows a linear trajectory from the output of the deflection region 114 to the screen 118. Linear trajectories are useful, for example, in color tubes having a lithographically exposed shadow mask. However, they also limit any reduction in the physical depth of the funnel region 116, because a shallower depth requires a greater deflection angle, which in turn produces a greater angle of incidence onto the display screen back surface (measured relative to its normal). A greater angle of incidence in turn can produce unacceptable spreading of the beam dot size when it strikes the screen. Beam dot size spreading is more severe at the extremes of horizontal deflection than vertical deflection, since maximum horizontal deflection is so much greater than vertical in standard aspect ratio CRTs. In addition, since shadow mask striping is typically vertical, the dot size spreading in the horizontal dimension can result in significantly less electron beam current striking the phosphor, and therefore significantly reduced brightness at the horizontal edges of the screen.

Accordingly, the funnel section 116 in the embodiment of FIG. 1 preferably contains a non-field-free region 134 created by electrically isolating the aluminum backing of the display screen 118 from the dag on the inner surface of the glass tube. The dag is still maintained at the primary accelerating potential of the electron gun 124, but a secondary accelerating potential is now created by maintaining the aluminum backing of the display screen 118 at a higher potential. For example, the aluminum backing might be maintained at twice the potential of the dag. The secondary acceleration within the cone section 116 tends to curve the beam more toward the display screen, so that it strikes the display screen at a narrower angle to the normal even at the horizontal extremes. Such an arrangement is known in the prior art of tubes without benders, and produces a shallower depth cone section for a given display screen diagonal dimension. The secondary accelerating potential also induces a fmal focusing action on the beam that aids in reducing electron repulsion defocusing.

Preferably, to produce a color embodiment, a conventional beam indexing method can be used rather than a shadow mask technique. Such a configuration would include a single gun, a multicolor screen with index stripes, and a beam position reporting mechanism. Besides better accommodating the nonlinear beam trajectories of the secondary acceleration field, a beam indexing technique can substantially avoid the brightness penalties inherent in shadow mask tubes. Shadow mask color tubes typically compensate for the brightness penalty by increasing the (only) accelerating potential by up to 50% or more, thereby requiring a significantly longer deflection yoke and/or higher deflection coil current in order to achieve the desired maximum horizontal and vertical deflection angles. A tube incorporating a beam indexing technique can avoid the increased accelerating potential and therefore can therefore be designed using either a significantly shorter deflection yoke and/or lower deflection coil current. This choice, too, can help reduce the overall depth of a cathode ray tube according to the invention.

Asymmetric Quadrupole Magnetic Lens

Typically it is desired that the electron beam have a cross-section that is longer in the vertical dimension than in the horizontal dimension of the screen. A 3:1 aspect ratio is often preferred. Such an elongated cross-sectional shape provides a number of advantages well recognized in the industry. In the embodiment of FIG. 1, a magnetic lens for producing a vertically elongated cross-sectional beam shape can be created by the addition of asymmetric quadrupole beam shaping magnets disposed along the path of the electron beam. These magnets, like all other magnetic structures on the tube, can be disposed outside the glass envelope 122, thereby simplifying manufacture.

The beam shaping magnets do not need to be located by themselves in a separate section of the electron beam path. Instead, they can overlap other sections of the path, for example the bender 112. FIG. 1 illustrates two alternative locations 140 and 142 for these magnets along the path of the beam 120. For each such location, there is a corresponding magnet (not shown in FIG. 1) on the underside of the glass bender section 112, oriented oppositely to the magnet orientation as visible from the top in FIG. 1. It can be seen that in position 140, the quadrupole magnets are disposed at a location along the beam path which is within the bender electron loop itself, both downstream of the beam intersection point 126 as the beam enters the bender section 112, and upstream of the beam intersection point 126 before the beam exits the bender section 112. In addition, in the embodiment of FIG. 1, the quadrupole magnets 140 can also be said to be disposed at a location along the beam path which is both downstream of the magnetic field stop 316 as the beam enters the bender section 112, and upstream of the magnetic field stop 316 before the beam exits the bender section 112. It can also be seen that in position 142, the quadrupole magnets are disposed at a location along the beam path which is downstream of the bender electron loop, and downstream of both the beam intersection point 126 and the magnetic field stop 316. Note that in another embodiment, more than one set of beam shaping magnets can be disposed at different positions along the electron beam path. For example, in one embodiment there are beam shaping magnets at both positions 140 and 142 as illustrated in FIG. 1.

Figure 5:
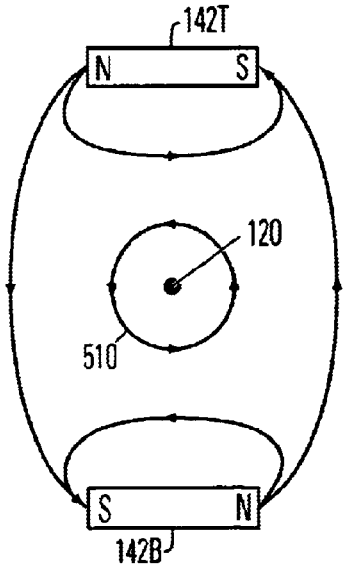
FIG. 5 is a front view of the electron beam passing through one of the magnetic lenses of FIG. 1.

The design of asymmetric quadrupole magnetic lens, sometimes referred to as a dipole lens, is within the ordinary level of skill in the art. As a general guide to some of the goals involved, however, FIG. 5 is a front view of the electron beam 120 passing through one of the magnetic lenses, for example lens 142. The view of FIG. 5 is taken from the front of the tube, looking upstream from the display screen, so the electron beam 120 is directed out of the page toward the viewer. The two magnets making up the magnetic lens 142 are designated 142T and 142B, the magnet 142T being the top magnet visible in FIG. 1, and the magnet 142B being the bottom magnet not visible in FIG. 1 because it is on the underside of the glass bender section 112. The flow of electrons in the electron beam 120 creates a circular magnetic field wrapping around the electron beam in the direction 510 illustrated in FIG. 5. Because it is desired to narrow the beam shape in the horizontal dimension and elongate it in the vertical dimension, it is desired to create magnetic fields that are oriented in the same direction as the circular field 510 on the left and right sides of the beam 120, and magnetic field that are oriented in the opposite direction as the circular field 510 on the top and bottom sides of the beam 120. These fields can be created by orienting in the top magnet 142T such that its North pole is on the left and its South pole is on the right, and by orienting the bottom magnet 142B such that its North pole is on the right and its South pole is on the left. This creates the static magnetic fields as desired as shown in FIG. 5.

Other magnetic lens structures will be apparent to a person of ordinary skill. For example, hexapole or octapole structures may be useful in some embodiments. As another example, one or more of the permanent magnets forming the lens can be replaced by electromagnets, thereby providing the flexibility to change the astigmatic shaping of the beam dynamically as the beam sweeps across the display screen. Such a structure can even be used to selectively tilt the major axis of the elongated beam cross-section to an angle, so as to better achieve a round or vertically elongated spot size when the beam strikes the display screen in the four corners thereof.

Glass Envelope

Figure 6:
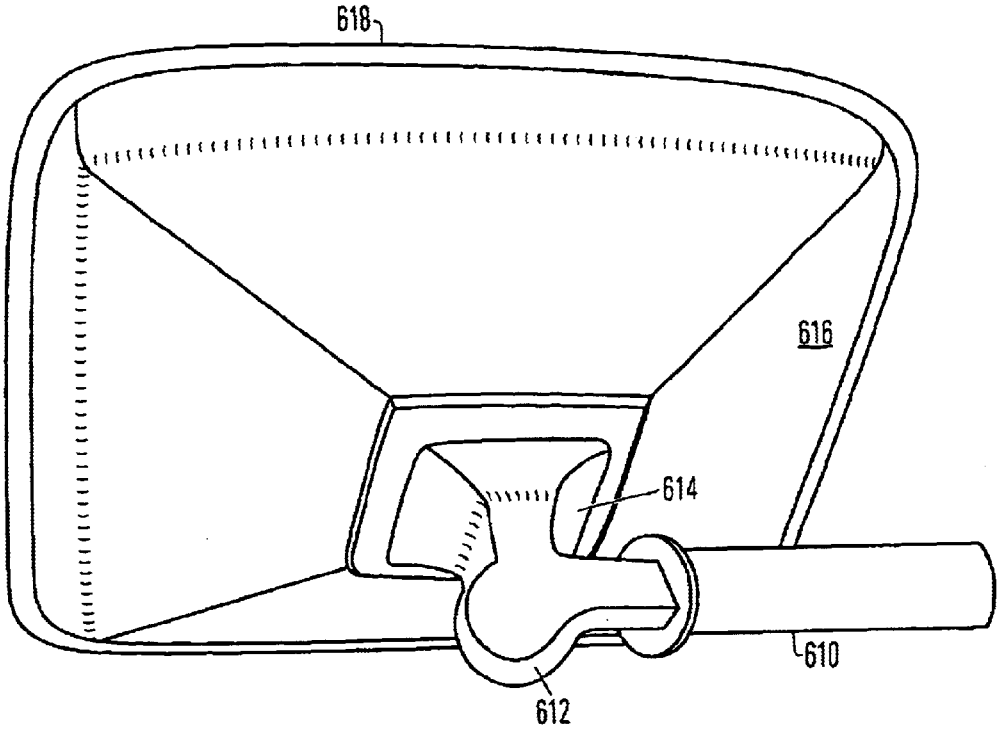
FIG. 6 is a left rear elevational view of a glass envelope which can be used to house and support the components illustrated in FIGS. 1, 2, 4 and 5.

FIG. 6 is a left rear elevational view of a glass envelope which can be used to house and support the components illustrated in FIGS. 1, 2, 4 and 5. It will be appreciated that the shapes illustrated in FIG. 6 represent only one embodiment; various other shapes can be used instead. In the embodiment of FIG. 6, the neck section comprises a hollow tube 610 extending out to the right. The hollow bender section 612 has a rectangular cross-section. It has an entrance or input port on the right, in communication with the neck tube 610, and an exit or output port oriented orthogonally to the input port and orthogonally to the display screen 618. While the two ports are separate openings in the bender glass section 612 in the embodiment of FIG. 6, it will be appreciated that in other embodiments, both the entrance and exit of the bender can occur through a single opening in the glass structure. The exiting port of bender section 612 flares out in two orthogonal dimensions both orthogonal to the electron beam path, in an electromagnetic deflection section 614. The yoke, not shown in FIG. 6, is disposed outside this section 614 of the glass envelope. The electromagnetic deflection section 614 opens up into the funnel section 616 of the display, which in turn terminates in the display screen 618. The entire glass envelope illustrated in FIG. 6 is evacuated.

The foregoing description of preferred embodiments of the present invention has been provided for the purposes of illustration and description. It is not intended to be exhaustive or to limit the invention to the precise forms disclosed. Obviously, many modifications and variations will be apparent to practitioners skilled in this art. In particular, and without limitation, any or all of the permanent magnets discussed or shown herein can be replaced by electromagnets if desired. In addition, any and all variations described, suggested or incorporated by reference in the Background section of this patent application are specifically incorporated by reference into the description herein of embodiments of the invention. The embodiments described herein were chosen and described in order to best explain the principles of the invention and its practical application, thereby enabling others skilled in the art to understand the invention for various embodiments and with various modifications as are suited to the particular use contemplated. It is intended that the scope of the invention be defined by the following claims and their equivalents.

What is claimed is:

1. Cathode ray tube apparatus comprising, in sequence along the path of an electron beam:

a magnetic loop bender aligned to receive said electron beam from an electron beam source position;

a biaxially controllable deflector; and a display screen, wherein said magnetic loop bender bends said electron beam through a bending angle that is between 180° and 360°, exclusive.

2. Apparatus according to claim 1, further comprising an electron gun aligned to provide said electron beam at said electron beam source position.

3. Apparatus according to claim 1, wherein said bending angle is between 225° and 315°, inclusive.

4. Apparatus according to claim 1, wherein said bending angle is approximately 270°.

5. Apparatus according to claim 1, wherein said bender comprises a glass bending section, and wherein said electron beam enters and exits said glass bending section through separate openings in said glass bending section.

6. Apparatus according to claim 1, wherein said magnetic loop bender comprises:

a bender magnet structure forming a bender magnetic field which is effective to bend said electron beam through said bending angle; and a magnetic field stop through which said electron beam passes both entering and exiting said bender, said magnetic field stop being disposed between said electron beam source position and said bender magnet structure.

7. Apparatus according to claim 1, wherein said magnetic loop bender comprises:

a bender magnet structure forming a bender magnetic field which is effective to bend said electron beam through said bending angle; and a magnetic field stop through which said electron beam passes exiting said bender, said magnetic field stop being disposed between said bender magnet structure and said controllable deflector.

8. Apparatus according to claim 1, wherein said magnetic loop bender comprises:

a bender magnet structure forming a bender magnetic field which is effective to bend said electron beam through said bending angle; and a magnetic field stop through which said electron beam passes both entering and exiting said bender, said magnetic field stop being disposed both between said electron beam source position and said bender magnet structure and between said bender magnet structure and said controllable deflector.

9. Apparatus according to claim 1, wherein said electron beam makes a loop in said bender, said loop having a plane, and wherein said bender comprises a bender magnet structure having north and south poles disposed on opposite sides of said plane of said loop, both said north and south poles terminating in a pole termination plane which is perpendicular to said plane of said loop.

10. Apparatus according to claim 9, wherein said pole termination plane bears a first angle to said electron beam as it enters said bender, said first angle being between 22.5 degrees and 67.5 degrees.

11. Apparatus according to claim 10, wherein said first angle is 45 degrees.

12. Apparatus according to claim 9, wherein said pole termination plane has a normal which bears an equal angle to said electron beam both entering and exiting said bender.

13. Apparatus according to claim 9, wherein said bender magnet structure includes a permanent magnet.

14. Apparatus according to claim 9, wherein said bender magnet structure comprises:

a magnet having north and south poles on opposite sides of said plane of said loop;

a first pole piece in magnetic flux communication with the north pole of said magnet and extending away from said north pole of said magnet and toward said electron beam in a first plane parallel to said plane of said loop; and a second pole piece in magnetic flux communication with the south pole of said magnet and extending away from said south pole of said magnet and toward said electron beam in a second plane parallel to said plane of said loop, wherein both said first and second pole pieces terminate in said pole termination plane.

15. Apparatus according to claim 9, comprising an evacuated glass envelope enclosing said electron beam, wherein said bender magnet structure is disposed outside said glass envelope.

16. Apparatus according to claim 9, wherein said bender further comprises a magnetic field stop disposed along said electron beam between said electron beam source position and said bender magnet structure.

17. Apparatus according to claim 16, wherein said magnetic field stop comprises a magnetic flux conductor having a surface nearest said bender magnet structure, said surface lying in a plane which is parallel to said pole termination plane.

18. Apparatus according to claim 16 comprising an evacuated glass envelope enclosing said electron beam, wherein said magnetic field stop is disposed outside said glass envelope.

19. Apparatus according to claim 18, further comprising an additional magnetic flux conductor disposed outside said glass envelope between said electron beam source position and said magnetic field stop.

20. Apparatus according to claim 19, wherein said additional magnetic flux conductor comprises iron wire encircling said glass envelope.

21. Apparatus according to claim 9, wherein said bender further comprises a magnetic field stop disposed along said electron beam between said bender magnet structure and said controllable deflector.

22. Apparatus according to claim 9, wherein said bender further comprises a magnetic field stop through which said electron beam passes both entering and exiting said bender, said magnetic field stop being disposed both between said electron beam source position and said bender magnet structure and between said bender magnet structure and said controllable deflector.

23. Apparatus according to claim 22, wherein said magnetic field stop comprises a magnetic flux conductor having a surface nearest said bender magnet structure, said surface lying in a field stop plane which is parallel to said pole termination plane.

24. Apparatus according to claim 23 comprising an evacuated glass envelope enclosing said electron beam, wherein said magnetic field stop is disposed outside said glass envelope.

25. Apparatus according to claim 23, wherein said electron beam intersects itself at a beam intersection point, and wherein said field stop plane also includes said beam intersection point.

26. Apparatus according to claim 1, further comprising at least a first asymmetric magnetic lens disposed along said electron beam path between said electron beam source position and said controllable deflector.

27. Apparatus according to claim 26, wherein said magnetic lens is arranged to narrow a spot created by said electron beam on said display screen in a horizontal dimension of said display screen.

28. Apparatus according to claim 26, wherein said magnetic lens is arranged to elongate a spot created by said electron beam on said display screen in a vertical dimension of said display screen.

29. Apparatus according to claim 26, wherein said magnetic lens is arranged to narrow a spot created by said electron beam on said display screen in a horizontal dimension of said display screen, and to elongate said spot in a vertical dimension of said display screen.

30. Apparatus according to claim 26, wherein said electron beam intersects itself at a beam intersection point, and wherein said asymmetric magnetic lens is disposed downstream of said beam intersection point after said electron beam path enters said bender, but upstream of said beam intersection point before said electron beam path exits said bender.

31. Apparatus according to claim 26, wherein said electron beam intersects itself at a beam intersection point, and wherein said asymmetric magnetic lens is disposed downstream of said beam intersection point after said electron beam path exits said bender.

32. Apparatus according to claim 26, wherein said bender comprises:

a bender magnet structure forming a bender magnetic field which is effective to bend said electron beam through said bending angle; and a magnetic field stop through which said electron beam path passes both entering and exiting said bender, said magnetic field stop being disposed both between said electron beam source position and said bender magnet structure and between said bender magnet structure and said controllable deflector, wherein said asymmetric magnetic lens is disposed downstream of said magnetic field stop after said electron beam path enters said bender, but upstream of said magnetic field stop before said electron beam path exits said bender.

33. Apparatus according to claim 26, wherein said bender comprises:

a bender magnet structure forming a bender magnetic field which is effective to bend said electron beam through said bending angle; and a magnetic field stop through which said electron beam path passes exiting said bender, said magnetic field stop being disposed between said bender magnet structure and said controllable deflector, and wherein said asymmetric magnetic lens is disposed downstream of said magnetic field stop after said electron beam path exits said bender.

34. Apparatus according to claim 26, further comprising a second asymmetric magnetic lens disposed along said electron beam path between said electron beam source position and said controllable deflector.

35. Apparatus according to claim 34, wherein said bender comprises:

a bender magnet structure forming a bender magnetic field which is effective to bend said electron beam through said bending angle; and a magnetic field stop through which said electron beam path passes both entering and exiting said bender, said magnetic field stop being disposed both between said electron beam source position and said bender magnet structure and between said bender magnet structure and said controllable deflector, wherein said first asymmetric magnetic lens is disposed downstream of said magnetic field stop after said electron beam path enters said bender, but upstream of said magnetic field stop before said electron beam path exits said bender, and wherein said second asymmetric magnetic lens is disposed downstream of said magnetic field stop after said electron beam path exits said bender.

36. Apparatus according to claim 26, wherein said asymmetric magnetic lens comprises at least one permanent magnet.

37. Apparatus according to claim 26, wherein said asymmetric magnetic lens comprises an asymmetric quadrupole magnetic lens.

38. Apparatus according to claim 26, comprising an evacuated glass envelope enclosing said electron beam, wherein all structure for forming said at least one asymmetric magnetic lens is disposed outside said glass envelope.

39. Apparatus according to claim 1, wherein said biaxially controllable deflector comprises an electromagnetic deflection yoke.

40. Apparatus according to claim 1, further comprising an electrostatic electron beam acceleration field between said controllable deflector and said display screen.

41. Apparatus according to claim 1, further comprising an electron gun aligned to provide said electron beam at said electron beam source position, said electron gun having a high voltage terminal held at a first high voltage, wherein said display screen includes an electrically conductive backing held at a second high voltage higher than said first high voltage.

42. Apparatus according to claim 41, wherein said apparatus comprises an evacuated glass envelope containing said electron gun, said electron beam path and said display screen, said glass envelope further including a cone section between said bender and said display screen, wherein said glass envelope from said cone section back to said electron gun includes an internal electrically conductive coating which is held at said first high voltage.

43. Cathode ray tube apparatus comprising:

an electron gun;

a biaxially controllable deflector downstream of said electron gun;

a display screen downstream of said controllable deflector; and a magnetic loop bender disposed downstream of said electron gun but upstream of said controllable deflector, said bender having a bender magnet structure which includes north and south poles disposed on opposite sides of a bending plane defined by central axes of said electron gun and said controllable deflector, both said north and south poles terminating in a pole termination plane which is perpendicular to said bending plane, wherein said bender magnet structure is sufficient to bend an electron beam from said electron gun through a bending angle that is between 225° and 315°, inclusive.

44. Apparatus according to claim 43, wherein said bending angle is approximately 270°.

45. Apparatus according to claim 43, wherein said pole termination plane bears a first angle to said central axis of said electron gun, said first angle being between 22.5 degrees and 67.5 degrees.

46. Apparatus according to claim 45, wherein said first angle is 45 degrees.

47. Apparatus according to claim 43, wherein said pole termination plane has a normal which bears an equal angle to both said central axis of said electron gun and said central axis of said controllable deflector.

48. Apparatus according to claim 43, wherein said bender magnet structure includes a permanent magnet.

49. Apparatus according to claim 43, wherein said bender magnet structure comprises:

a magnet having north and south poles on opposite sides of said bending plane;

a first pole piece in magnetic flux communication with the north pole of said magnet and extending away from said north pole of said magnet and toward said electron gun and/or said controllable deflector in a first plane parallel to said bending plane; and a second pole piece in magnetic flux communication with the south pole of said magnet and extending away from said south pole of said magnet and toward said electron gun and/or said controllable deflector in a second plane parallel to said plane of said loop, wherein both said first and second pole pieces terminate in said pole termination plane.

50. Apparatus according to claim 43, comprising an evacuated glass envelope enclosing said electron beam, wherein said bender magnet structure is disposed entirely outside said glass envelope.

51. Apparatus according to claim 43, wherein said bender further comprises a magnetic field stop disposed downstream of said electron gun and upstream of said bender magnet structure.

52. Apparatus according to claim 51, wherein said magnetic field stop comprises a magnetic flux conductor having a surface nearest said bender magnet structure, said surface lying in a plane which is parallel to said pole termination plane.

53. Apparatus according to claim 51 comprising an evacuated glass envelope enclosing an electron beam path from said electron gun to said display screen, wherein said magnetic field stop is disposed outside said glass envelope.

54. Apparatus according to claim 53, further comprising iron wire encircling said glass envelope between said electron gun and said magnetic field stop.

55. Apparatus according to claim 53, further comprising flat magnetic shield material encircling said glass envelope between said electron gun and said magnetic field stop.

56. Apparatus according to claim 43, wherein said bender further comprises a magnetic field stop disposed downstream of said electron gun and upstream of said controllable deflector, and both upstream and downstream of said bender magnet structure.

57. Apparatus according to claim 56, wherein said magnetic field stop comprises a magnetic flux conductor having a surface nearest said bender magnet structure, said surface lying in a field stop plane which is parallel to said pole termination plane.

58. Apparatus according to claim 57, comprising an evacuated glass envelope enclosing an electron beam path from said electron gun to said display screen, wherein said magnetic field stop is disposed outside said glass envelope.

59. Apparatus according to claim 43, further comprising first and second oppositely oriented magnets disposed on opposite sides of said bending plane, downstream of said electron gun and upstream of said controllable deflector.

60. Apparatus according to claim 59, wherein said bender further has a magnetic field stop disposed both downstream of said electron gun and upstream of said bender magnet structure, and downstream of said bender magnet structure and upstream of said controllable deflector, wherein said first and second magnets are disposed downstream of said magnetic field stop after said electron beam path enters said bender, but upstream of said magnetic field stop before said electron beam path exits said bender.

61. Apparatus according to claim 59, wherein said bender further has a magnetic field stop disposed downstream of said bender magnet structure and upstream of said controllable deflector, and wherein said first and second magnets are disposed downstream of said magnetic field stop after said electron beam path exits said bender.

62. Apparatus according to claim 59, wherein at least one of said first and second magnets comprise a permanent magnet.

63. Apparatus according to claim 59, comprising an evacuated glass envelope enclosing said electron beam, wherein said first and second magnets are both disposed outside said glass envelope.

64. Apparatus according to claim 43, wherein said biaxially controllable deflector comprises an electromagnetic deflection yoke.

65. Apparatus according to claim 43, further comprising an electrostatic electron beam acceleration field downstream of said controllable deflector and upstream of said display screen.

66. A method for controlling an electron beam in a cathode ray tube, comprising the steps of:

providing said electron beam from an electron beam source position;

magnetically bending said electron beam through a bending angle that is between 180° and 360°, exclusive; and biaxially and controllably deflecting said electron beam toward desired positions on a display screen after said step of bending.

67. A method according to claim 66, wherein said step of providing an electron beam from an electron beam source position comprises the step of emitting said electron beam from an electron gun.

68. A method according to claim 67, wherein said bending angle is between 225° and 315°, inclusive.

69. A method according to claim 67, wherein said bending angle is approximately 270°.

70. A method according to claim 67, further comprising the step of passing said electron beam through a magnetic field stop before said step of bending.

71. A method according to claim 67, further comprising the step of passing said electron beam through a magnetic field stop both before and after said step of bending.

72. A method according to claim 67, further comprising the step of passing said electron beam through at least one asymmetric magnetic lens prior to said step of controllably deflecting said electron beam.

73. A method according to claim 72, wherein said step of passing said electron beam through at least one asymmetric magnetic lens occurs coincidentally with said step of bending.

74. A method according to claim 72, wherein said step of passing said electron beam through at least one asymmetric magnetic lens occurs after said step of bending.

75. A method according to claim 72, further comprising the step of magnetically elongating a spot created by said electron beam on said display screen in a vertical dimension of said display screen, prior to said step of controllably deflecting said electron beam.

76. A method according to claim 67, further comprising the step of magnetically narrowing a spot created by said electron beam on said display screen in a horizontal dimension of said display screen, prior to said step of controllably deflecting said electron beam.

77. A method according to claim 67, further comprising the step of accelerating said electron beam towards said display screen after said step of controllably deflecting said electron beam.

* * * * *

UNITED STATES PATENT AND TRADEMARK OFFICE

CERTIFICATE OF CORRECTION

PATENT NO. : 6,617,779 B1
DATED : September 9, 2003
INVENTOR(S) : Samuel A. Schwartz It is certified that error appears in the above-identified patent and that said Letters Patent is hereby corrected as shown below:

Column 6, line 51 through Column 7, line 22,
After "a", please delete the text, beginning at "For" and ending in up to and including "not".

Column 6,
Line 16, please insert said text beginning prior to "heretofor".

Signed and Sealed this

Twenty-eighth Day of October, 2003

JAMES E. ROGAN
*Director of the United States Patent and Trademark Office*